US006289902B1

(12) United States Patent
Mathiez

(10) Patent No.: US 6,289,902 B1
(45) Date of Patent: Sep. 18, 2001

(54) ABLATION PROCESS INVOLVING BRISTLES ON A MASCARA BRUSH AND THE MASCARA BRUSH OBTAINED BY SUCH PROCESS

(75) Inventor: Jean-Louis Mathiez, Limours (FR)

(73) Assignee: Coty S.A., Paris (FR)

( * ) Notice: Subject to any disclaimer, the term of this patent is extended or adjusted under 35 U.S.C. 154(b) by 0 days.

(21) Appl. No.: 09/514,702

(22) Filed: Feb. 28, 2000

(51) Int. Cl.[7] ..... A45D 40/26; A45D 40/24; A46B 11/00

(52) U.S. Cl. ..... 132/218; 132/317; 132/320; 401/129; 401/128; 401/122

(58) Field of Search ..... 132/218, 317, 132/320, 313; 401/129, 128, 122

(56) References Cited

U.S. PATENT DOCUMENTS

| | | | | |
|---|---|---|---|---|
| 4,403,624 | * | 9/1983 | Montgomery | 132/218 |
| 4,433,928 | | 2/1984 | Kingsford | 401/122 |
| 4,586,520 | * | 5/1986 | Brittain | 132/218 |
| 4,810,122 | | 3/1989 | Cole | 401/122 |
| 5,020,551 | * | 6/1991 | Gueret | 132/200 |
| 5,133,590 | * | 7/1992 | Fitjer | 300/21 |
| 5,165,760 | * | 11/1992 | Gueret | 300/21 |
| 5,551,456 | | 9/1996 | Hartel | 132/218 |
| 5,595,198 | | 1/1997 | Kemmerer | 132/218 |
| 5,933,906 | * | 8/1999 | Rackley | 15/167.1 |
| 6,026,824 | * | 2/2000 | Gueret | 132/218 |

FOREIGN PATENT DOCUMENTS

| | | | |
|---|---|---|---|
| 2170996 | 8/1986 | (GB) | A64B/9/02 |

* cited by examiner

*Primary Examiner*—John J. Wilson
*Assistant Examiner*—Robyn Kieu Doan
(74) *Attorney, Agent, or Firm*—Schwegman, Lundberg, Woessner & Kluth, P.A.

(57) ABSTRACT

The process according to the invention comprises twisting a plastically deformable wire, typically of metal, so that it imprisons fibers within it, with the parts of the fibers projecting from the wire forming bristles in a helicoidal spiral, and of shaving off some of the bristles in predefined angular sectors by using the twisted wire to guide the components causing the total or partial ablation of the bristles.

14 Claims, 5 Drawing Sheets

ABLATION PROCESS INVOLVING BRISTLES ON A MASCARA BRUSH AND THE MASCARA BRUSH OBTAINED BY SUCH PROCESS

BACKGROUND OF THE INVENTION

The present invention relates to an ablation process involving bristles on a mascara brush and to a brush obtained by the process.

Mascara is conventionally packaged in a small container equipped with scraping element. A brush is normally integrally connected to a capsule equipped with a rod that screws into the container. When the brush is extracted from the container, an internal radial lip of the scraping element is applied against the bristles of the brush to remove any excess mascara.

For the same internal diameter, the scraping element, by being rubbed against the brush, is able to scrape off more excess product from a brush having long bristles than one with short bristles. On the one hand, the short bristles, or the interstices between bristles, are needed to store product to be applied to the user's eyelashes. On the other hand, long bristles are needed to properly comb and separate the eyelashes.

There is, therefore, a need for a mascara brush that is capable of meeting the users' needs.

SUMMARY OF THE INVENTION

One embodiment of the present invention comprises a brush that is capable of applying a significant amount of mascara in a single application to give volume to the eyelashes.

Another embodiment of the present invention comprises a brush capable of combing and separating the eyelashes, curling the eyelashes, and capable of applying a uniform layer of mascara, at low cost.

One other embodiment of the present invention comprises a process that comprises twisting a plastically deformable wire, typically of metal, so that it imprisons fibers within it, with the parts of the fibers projecting from the wire forming bristles in a helicoidal spiral, and shaving off some of the bristles in predefined angular sectors by using the twisted wire to guide components causing the total or partial ablation of the bristles.

Another embodiment of the present invention comprises a tool for ablation of the bristles that is strong enough not to be damaged by the wire and that does not destroy the wire by dislocating the brush. Guidance of the tool may be direct, mechanical, for example, by using a cutting tool such as a blade, milling tool, or grinding wheel on the wire. In the case of "contact free" ablation by laser beam, ultrasound, or water jet, guidance of the ablation tool may be provided, for example, by a probe resting on the wire or by an automatic control device comprising a mechanism, such as an optical mechanism, to detect the position of the wire.

One manufacturing process for manufacturing a mascara brush of the present invention comprises: positioning the bristles parallel to one another, and shifting the bristles longitudinally and between two segments of at least one plastically deformable wire, the bristles being roughly perpendicular to the wire; twisting the plastically deformable wire so as to form with the bristles a helicoidal spiral, characterized in that it also includes making a partial or total ablation in angular sectors of the helicoidal spiral formed by the bristles by the horizontal motion of at least one cutting element, with the cutting component being guided by the twisted wire.

The manufacturing process of the present invention is characterized in that it comprises simultaneously implementing multiple cutting elements in order to form simultaneously several sectors that are free of bristles or that are provided with shorter bristles. The multiple cutting elements are distributed at regular angles about the axis of the plastically deformable twisted wire. In one embodiment, the cutting element is a blade. The blade is positioned tangentially to the axis of the plastically deformable twisted wire. The blade forms an acute angle in relation to the axis of the plastically deformable wire.

Another embodiment of the present invention includes a process characterized in that the brush is introduced in a bore formed in a part whose inner diameter is greater than the diameter of the plastically deformable twisted wire and smaller than the outer diameter of the brush bristles, deployed in such a way as to bend the bristles and center the brush, and in which step the bent bristles are cut. The blades are positioned at the outlet of the bore.

For one embodiment of the process of the present invention, a tube includes an opening permitting application of a cutting tool on the brush whose bristles are to be shaved off.

For another embodiment of the process of the present invention, the opening is a narrow longitudinal opening which selects the bristles with an angle $\beta$, corresponding to the sector in which ablation of the bristles is to take place. For some embodiments, the process implements multiple longitudinal openings, each of which corresponds to a separate cutting tool. The process further includes a step to center the brush whose bristles are to be cut between multiple cutting components positioned at regular angles around the brush whose bristles are to be cut.

The process also includes applying a rotary tool chosen from the set comprising a circular saw, a milling tool, and a grinding wheel. The rotary cutting tool penetrates the narrow opening. The rotary tool is disk-shaped and is applied with the edge to the plastically deformable twisted wire.

Another embodiment of the present invention is likewise a mascara brush including angular sectors provided with bristles having a first length, and sectors free of bristles or provided with bristles that are shorter than the bristles of the sector. For one embodiment of the mascara brush, the sectors with bristles are distributed at regular angles about the axis of a plastically deformable twisted wire.

One other process is characterized in that the opening is a narrow longitudinal opening which selects the bristles with an angle, corresponding to the sector in which ablation of the bristles is to take place. For one embodiment, the process is characterized in that it implements multiple longitudinal openings, each of which corresponds to a separate cutting tool. The process is further characterized in that it includes centering the brush whose bristles are to be cut between multiple cutting components positioned at regular angles around the brush whose bristles are to be cut. The process is further characterized in that it includes a step comprising application of a rotary tool chosen from the set comprising a circular saw, a milling tool, and a grinding wheel. The rotary cutting tool penetrates the narrow opening.

The process is further characterized in that the rotary tool is disk-shaped and in that it is applied with the edge to the plastically deformable twisted wire.

Another embodiment of the present invention is likewise a mascara brush including angular sectors provided with bristles having a first length, and sectors free of bristles or provided with bristles that are shorter than the bristles of the sector. The mascara brush is characterized in that the sectors with bristles are distributed at regular angles about the axis of a plastically deformable twisted wire.

The invention shall be better understood with the aid of the following description and the attached drawings given by way of nonlimiting examples.

DESCRIPTION OF THE DRAWINGS

The same reference numbers are used to designate identical components in FIGS. 1 to 13.

DETAILED DESCRIPTION

One embodiment of the process of the present invention comprises twisting a plastically deformable wire, typically of metal, so that it imprisons fibers within it, with the parts of the fibers projecting from the wire forming bristles in a helicoidal spiral, and of shaving off some of the bristles in predefined angular sectors by using the twisted wire to guide the components causing the total or partial ablation of the bristles.

A tool chosen for ablation of the bristles is strong enough not to be damaged by the wire. Likewise, the tool does not destroy the wire by dislocating the brush. Guidance is direct, mechanical, for example, by using a cutting tool such as a blade, milling tool or grinding wheel on the wire. In the case of "contact-free" ablation by laser beam, ultrasound, or water jet, guidance of the ablation tool is provided, for example, by a probe resting on the wire or by an automatic control device comprising a mechanism such as optical mechanism to detect the position of the wire.

Figure 1:
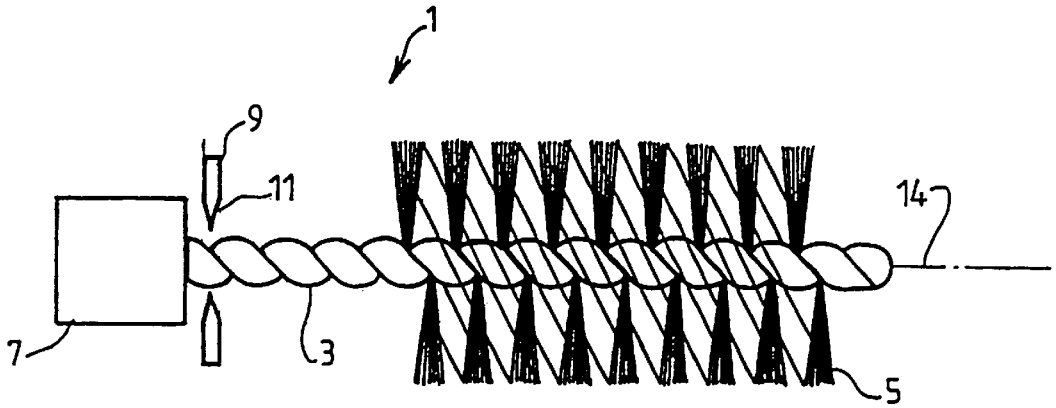
FIG. 1 is a side view of a brush capable of being shaved off according to the process of the present invention.

One mascara brush embodiment of the present invention, illustrated generally in FIG. 1 shows mascara brush 1, comprising one or more twisted wires 3 imprisoning bristles 5 forming a helicoidal spiral, where the bristles are distributed at regular angles. One end of twisted wire 3 supports capsule 7 to seal container 8, which is provided with scraping element 9. The outer envelope of the fibers of the brush may be in the form of a cylinder, cone, truncated cone, etc.

When the capsule is screwed into the container, bristles 5 are immersed in the mascara. At that time, brush 1 is overloaded with mascara. Its removal from the container causes bristles 5 to pass through radial circular lip 11 of scraping element 9 that removes excess product. However, with a known type of brush, where all bristles 5 have the same length, scraping element 9 tends to remove too much product. Thus, the process according to the present invention permits the complete or partial ablation of some bristles 5 located in predetermined angular sectors. As a variant, ablation is performed in a helicoidal spiral. In the example illustrated in FIG. 2, the brush according to the invention includes three sectors 13 of bristles 5 with angle, preferably regularly distributed about axis 14 of wire 3 and separated by three sectors 15 with angle $\beta$ preferably regularly distributed about axis 14 of wire 3, free of bristles, or as a variant, having shorter bristles 5.

Figure 3:
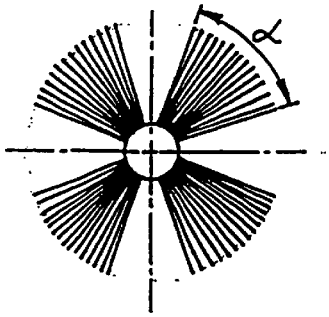
FIG. 3 is a front view of a second embodiment of the brush according to the present invention.

The example illustrated in FIG. 3 shows a brush 1 according to the invention comprising four sectors 13 of bristles 5 with angle $\alpha$, preferably distributed at regular angles and separated by four sectors 15 with angle $\beta$, preferably distributed at regular angles and free of bristles or having shorter bristles 5.

Figure 4:
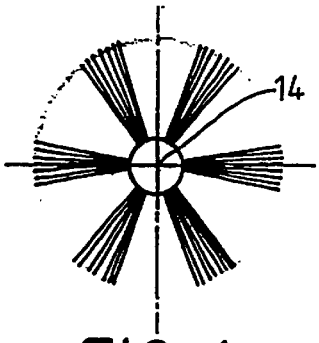
FIG. 4 is a front view of a third embodiment of a brush according to the present invention.

FIG. 4 shows brush 1 according to the invention comprising six sectors 13 of bristles 5 with angle $\alpha$, preferably regularly distributed about axis 14 of wire 3 and separated by six sectors 5 with angle $\beta$, preferably regularly distributed about axis 14 of wire 3 and free of bristles or, as a variant, having shorter bristles 5.

It is well understood that brushes 1 comprising sectors 13 and 15 that are not distributed at regular angles as well as brushes comprising many sectors 13 with different angles $\alpha$ and/or $\beta$ will not thereby exceed the scope of the invention.

Figure 2:
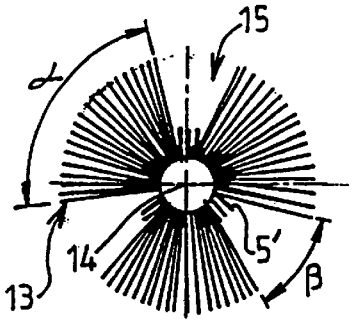
FIG. 2 is a front view of a first embodiment of the brush according to the present invention.

Brush 1 according to the invention, as illustrated in FIGS. 2 to 4, when introduced in the mascara container is able to hold mascara in long bristles 5 of sectors 13 as well as in sectors 15 free of bristles or provided with shorter bristles 5'. when the brush is removed from the container, lip 11 of scraping element 9 primarily encloses bristles 5 of sectors 13 which are scraped clean while a significant amount of mascara is retained in sectors 15 free of bristles 5 or provided with shorter bristles 5', as well as in long bristles 5 in sectors 13 at the edges of sectors 15. The brush according to the invention presents ideal conditions to ensure application of mascara on the user's eyelashes. In fact, the brush is supplied with a large amount of deposited mascara, while containing long bristles 5 that are capable of brushing, separating, and possibly curling the user's eyelashes at the same time as a uniformly thick layer of mascara is applied to give volume to the eyelashes.

A process according to the invention will be described below.

First, fibers such as polyamide, particularly polyamide –6.6 or other synthetic or natural fibers, whether hollow or solid, are distributed between two segments of wire 3, advantageously made of metal in the form of a U (hairpin wire). The wire is twisted into a helix to form a brush.

Once the wire is twisted, the brush is advantageously cut so as to obtain the desired outer envelope of the fibers, cylindrical, for example, as illustrated in FIG. 1. Then bristles 5 are subject to partial or total ablation in sectors 15. Advantageously, ablation of bristles 5 in all sectors 15 occurs simultaneously by using multiple cutting tools, specifically, blades. In the example illustrated in FIG. 5, two blades 17 are positioned tangentially in relation to twisted wire 3 on which they rest in diametrically opposite areas.

Figure 5:
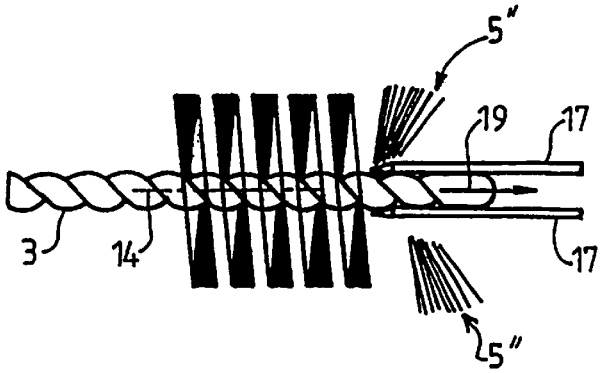
FIG. 5 is a side view illustrating the shaving of bristles on the brush of FIG. 1.
Figure 6:
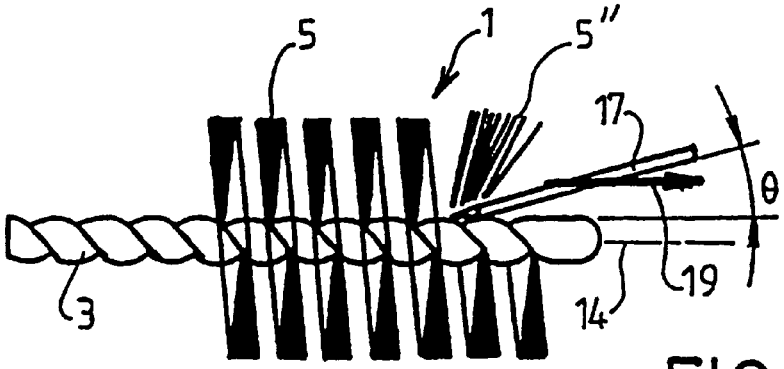
FIG. 6 is a side view illustrating a second example of the bristle shaving process according to the present invention.

In the example illustrated in FIG. 6, blade 17 is at an angle θ not equal to zero in relation to the axis of twisted wire 3. For example, angle θ is between 0° and 90°, and preferably between 5° and 45°. By shifting brush 1 in relation to blades 17 in the direction of arrow 19, bristles 5 are subject to ablation in areas Z known as future sectors 15. In addition to the horizontal motion indicated by arrow 19, blade 17 may be driven in a vibratory motion or in an oscillating straight line. The cut bristles in FIG. 5 are indicated by the number 5". The horizontal shift of blades 17 in relation to brush 1 advantageously proceeds over the entire length of the brush containing bristles 5. The fact that blades 17 are applied against wire 1 results in precise guidance and quick cutting. The length of the bristle cut will also depend on the rigidity of bristles 5. The distance between the blade or blades 17 and twisted wire 3 is advantageously very small, preferably nonexistent.

Direct guidance of blades 17 is provided by twisted wires 3, or by means of a part such as a cylindrical part (not shown).

Figure 7:
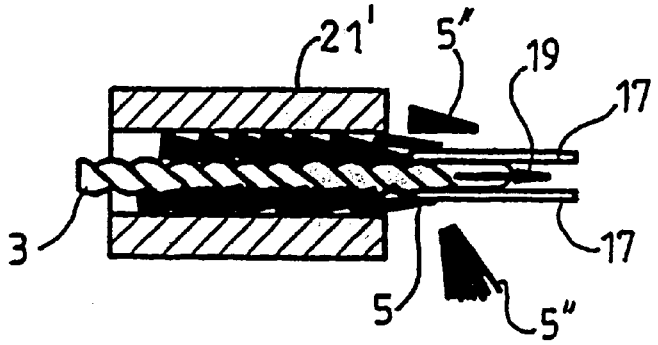
FIG. 7 is a side view illustrating a third example of the bristle shaving process according to the present invention.

It may be advantageous to guide brush 1 during its cutting. In FIG. 7, such guidance is provided by tube 21 whose inner diameter is greater than the outer diameter of twisted wire 3 but less than that of brush 1 with deployed bristles 5. Blades 17 are placed at the outlet of tube 21. Bristles 5 ensure that brush 1 is centered in tube 21.

Figure 8:
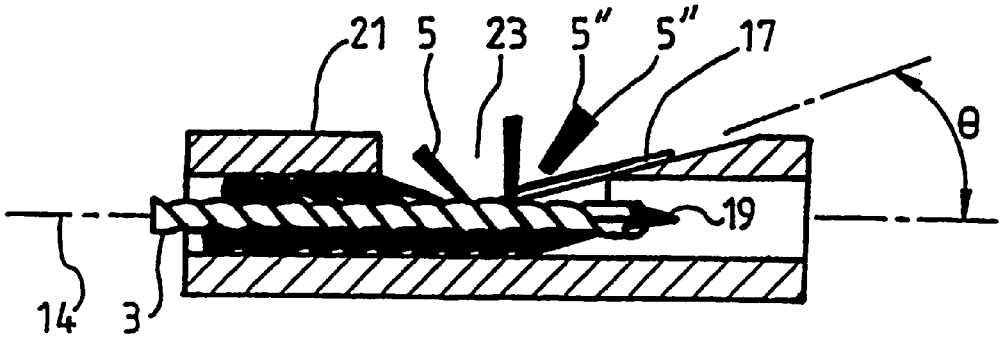
FIG. 8 is a side view illustrating a fourth example of the bristle shaving process according to the present invention.

In a variant illustrated in FIG. 8, tube 21 includes one or more openings 23, each of which permits passage of a cutting tool, in particular blade 17, toward the bristles to be cut.

In the example illustrated in FIG. 8, blade 17 forms an acute angle 0 with the axis of twisted wire 3. It is well understood that the use of a blade tangential to twisted wire 3 or, on the contrary, perpendicular to it is within the scope of the invention.

In the illustrated example, the length of opening 23 is sufficient to permit deployment of bristles 5 before they are cut. In a variant, not illustrated, blade 17 is positioned in such a way as to cut bristles 5 bent by tube 23.

Figure 9:
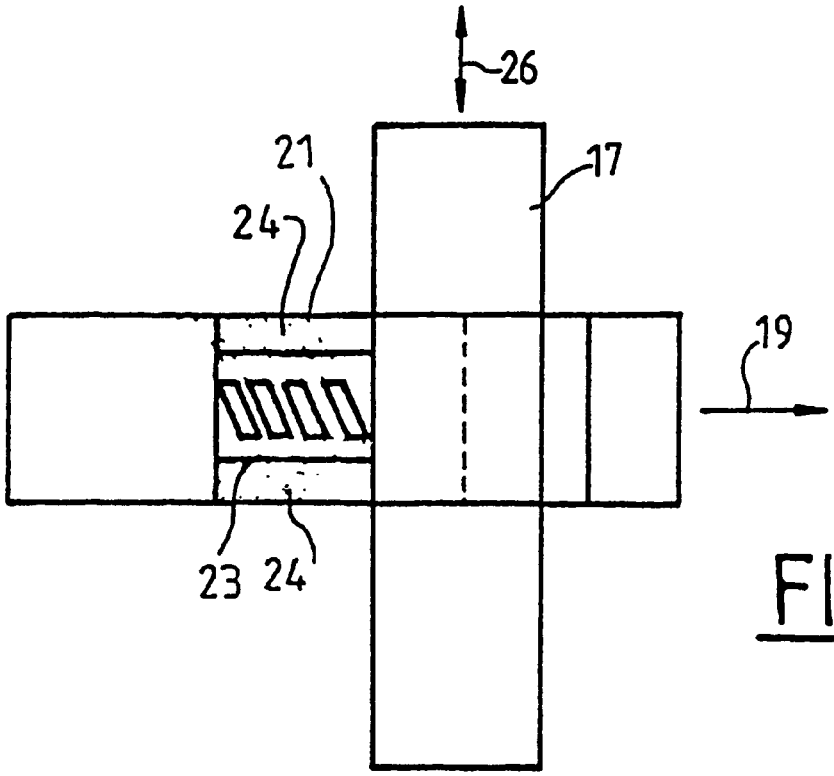
FIG. 9 is a plan view of a first embodiment of the shaving device of FIG. 8.
Figure 10:
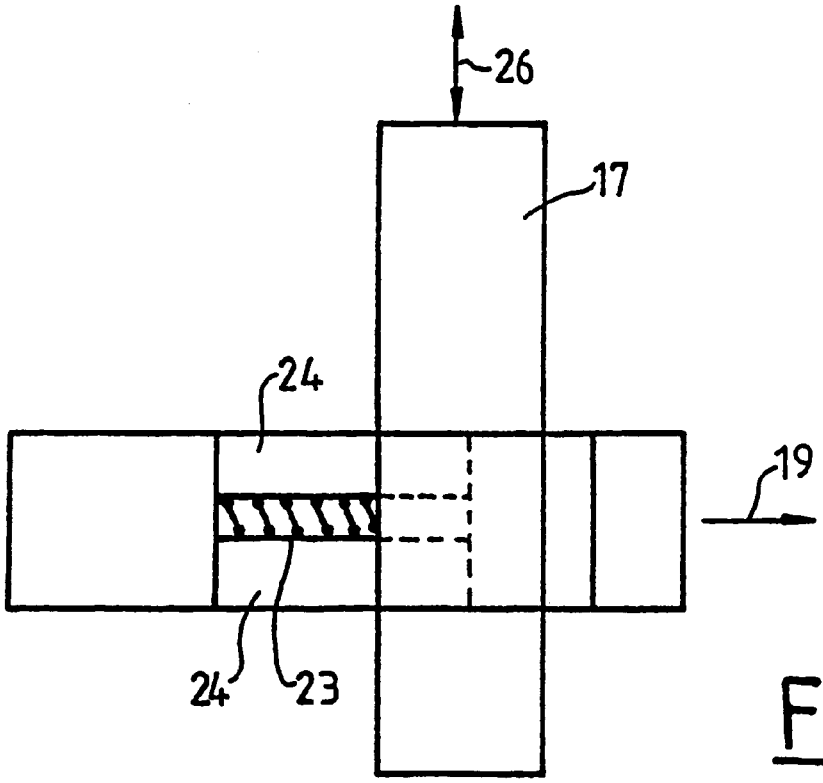
FIG. 10 is a plan view of a second embodiment of the shaving device of FIG. 8.
Figure 11:
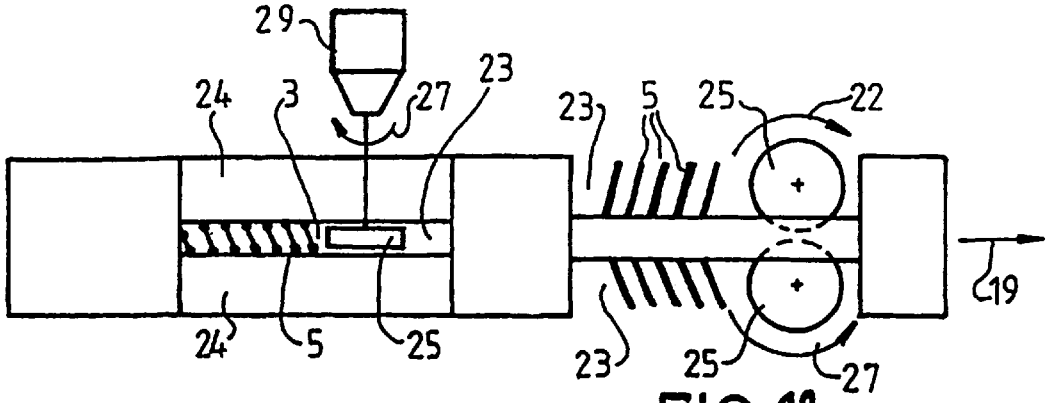
FIG. 11 is a plan view of a third embodiment of the shaving device of FIG. 8.
Figure 12:
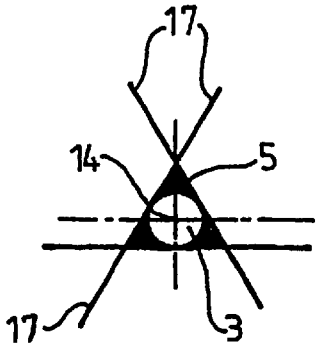
FIG. 12 is a front view illustrating a fifth bristle shaving example according to the present invention.
Figure 13:
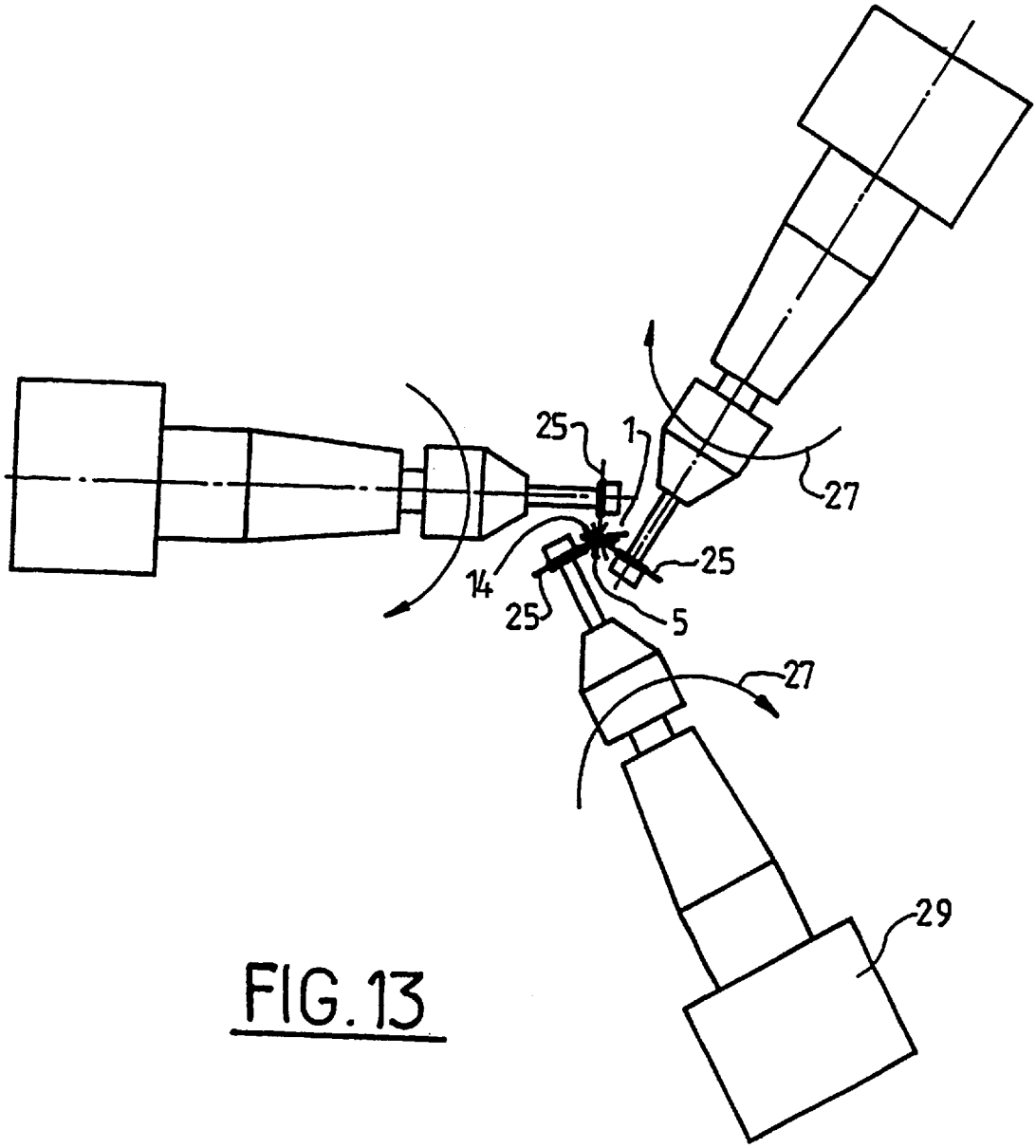
FIG. 13 is a front view of a brush passing through the center of a bristle ablation device according to the present invention.

FIGS. 9 to 11 show different shaped openings 23 in combination with different cutting tools. In FIG. 9, tube 21 is provided with a wide opening 23 corresponding, for example, to ablation of a sector of the tube between ¼ of the tube (90°) and ¾ of the tube (270°), equal to half (180°), for example, along part of the length of tube 21. The edges 24 of opening 23 are advantageously cut so as not to hinder the cutting tool, in particular blade 17. Wide opening 23 in FIG. 9 does not select the bristles 5 to be cut. On the contrary, in FIGS. 10 and 11, tube 21 contains a narrow opening 23, such as a slit, which selects the bristles 5 to be cut. Opening 23 advantageously presents an angular extension defined by two planes passing through the axis of tube 21 and through the edges of opening 23, corresponding to angle β of the corresponding sector 15.

The ablation device for bristles 5 according to the invention advantageously includes a device, such as a piston type device, to cause the brush to advance in the direction of arrow 19 in relation to tube 21 and the cutting tool. For example, an automatic device introduces a brush in tube 21, and the piston causes it to advance until it is ejected from the outlet of the tube. The piston moves horizontally in reverse in order to permit a new brush to be inserted in the tube.

Blade 17 is advantageously driven in a vibrating motion or, advantageously, in a horizontal motion according to arrow 26 perpendicular to arrow 19.

In the variant illustrated in FIG. 11, a circular saw, disk-shaped grinding wheel, or milling tool 25 penetrate opening 23 and cause ablation of bristles 5. In the preferred embodiment in FIG. 11, tube 21 includes two diametrically opposite narrow first openings 23 (slots), each of which permits introduction of a first milling tool 25, each of which is driven in rotation according to arrow 27 by a motor 29. Tube 21 includes two other diametrically opposite openings 23 in areas axially shifted from and similar to the first openings 23, which are on a plane perpendicular to the plane including the first two openings 23. Grinding wheel 25 cuts bristles 5 in each of said openings 23.

Grinding wheel 25 cuts bristles 5 off at the root where they emerge from wire 3. Two grinding wheels of the type used in model making may be used, in particular two grinding wheels containing hard aluminum oxide components.

The guiding component, such as tube 21, may be replaced by a block, such as one in the shape of a rectangular parallelepiped containing a bore that is preferably cylindrical.

In a variant illustrated in FIG. 9, bristles 5 of brush 1 ensure that wire 3 is centered between blades 17 distributed at regular angles. In the illustrated example, three blades are used which are shifted longitudinally along axis 14 of twisted wire 3, whose projection on a plane forms an equilateral triangle. The areas correspond to sectors 15 in which the bristles are to be subject to ablation.

It is well understood that the invention is not limited to the use of blades 17 which shave off bristles 5. In the example illustrated in FIG. 10, abrasive components are used, such as grinding wheels or milling tools 25 driven in rotation in the direction indicated by arrows 27 by motors 29. The axis of brush 1 is simultaneously driven in a horizontal motion perpendicular to the plane of FIG. 10. Advantageously, several grinding wheels or milling tools are used simultaneously to form several sectors 15. In the illustrated example, three milling tools 25 form three sectors 15. In a variant, the milling tools 25 may be replaced in the equipment in FIG. 10 by the blades of a circular saw.

It should be noted that it is not a problem if milling tools or grinding wheels 25 cut twisted wire 3 provided that any metal particles that could be considered potentially dangerous to the user be completely removed. Such eventual metal particles may be removed, for example, by a blower device and/or by a magnetic field (not shown).

In the example illustrated, grinding wheels 25 are disk-shaped and driven by axes located on a plane perpendicular to axis 14 of twisted wire 3. In a variant, grinding wheels or milling tools 25 are cylindrical in shape and their length is advantageously equal to the length of the part of brush 1 provided with bristles 5, the axes of the grinding wheels being parallel to axis 14 of twisted wire 3.

It is well-understood that the invention is not limited to the use of a twisted wire 3 with a straight axis 14.

The invention applies primarily to the cosmetics industry.

What is claimed is:

1. A manufacturing process for making a mascara brush comprising:

providing at least one cutting tool with a blade;

providing bristles;

providing at least one plastically deformable wire, the wire having two branch;

positioning the bristles parallel to one another, shifting longitudinally and between the two branches of at least one plastically deformable wire, the bristles being approximately perpendicular to the wire, the bristles and wire forming a brush;

providing a tube that defines multiple, narrow, longitudinal bores that select bristles with an angle beta that correspond to a sector in which ablation of the bristles occurs. the tube having an inner diameter that is greater than a diameter of the plastically deformable wire and smaller than the outer diameter of the brush, the tube having a symmetry that permits application of the cutting tool to the bristles of the brush;

deploying the tube in such a way as to bend the bristles, forming bent bristles, and to bend the center of the brush;

cutting the bent bristles with the cutting tool so that the cutting tool is guided by the twisted wire wherein bristles of the brush are shaved off; and twisting the plastically deformable wire so as to form with the bristles a helicoidal spiral, characterized in that the spiral includes a partial or total ablation of the bristles in angular sectors of the helicoidal spiral formed by the bristles (5) by the horizontal motion of at least one cutting component.

2. Process according to claim 1, characterized in that it comprises simultaneously implementing multiple cutting components (17) in order to simultaneously make several sectors (15) that are free of bristles (5) or provided with shorter bristles (5").

3. Process according to claim 2, characterized in that the multiple cutting components (17) are distributed at regular angles about the axis (14) of the plastically deformable twisted wire (3).

4. The process of claim 1, characterized in that the cutting component is a blade (17).

5. Process according to claim 4, characterized in that the blade (17) is positioned tangentially to the axis (14) of the plastically deformable twisted wire (3).

6. Process according to any one of claims 1 to 4, characterized in that the blade forms an acute angle (θ) in relation to the axis (14) of the plastically deformable wire (3).

7. Process according to any of the above claims, characterized in that the brush (1) is introduced in a bore (21) cut into apart whose inner diameter is greater than the diameter of the plastically deformable twisted wire (3) and smaller than the outer diameter of the brush (1) bristles (5) deployed in such a way as to bend the bristles (5) and center the brush (1), and in which the bent bristles are cut.

8. Process according to claim 7, characterized in that the blades (17) are positioned at the outlet of the bore (21).

9. Process according to any one of claims 1 to 6, characterized in that it includes a step to center the brush whose bristles are to be cut between multiple cutting components (17) positioned at regular angles around the brush whose bristles are to be cut.

10. Process according to claim 1,2, or 3, characterized in that it includes a rotary tool (25) chosen from among the set comprising a circular saw, a milling tool, and a grinding wheel.

11. Process according to claim 10, characterized in that rotary cutting tool (25) penetrates the narrow opening (23).

12. Process according to claim 10 or 11, characterized in that the rotary tool is disk-shaped and that its edge is applied to the plastically deformable twisted wire (3).

13. Mascara brush obtained by a process according to any of the preceding claims and including angular sectors (13) provided with bristles (5) having a first length, and sectors (15) free of bristles or provided with bristles (5') that are shorter than the bristles (5) of the sector (13).

14. Mascara brush according to claim 13, characterized in that the sectors (13) with bristles (5) are distributed at regular angles about the axis (14) of a plastically deformable twisted wire (3).

* * * * *